US010152924B2

(12) United States Patent
Kim et al.

(10) Patent No.: US 10,152,924 B2
(45) Date of Patent: Dec. 11, 2018

(54) ORGANIC LIGHT EMITTING DIODE DISPLAY DEVICE INCLUDING PEAK LUMINANCE CONTROLLING UNIT AND METHOD OF DRIVING THE SAME

(71) Applicant: LG DISPLAY CO., LTD., Seoul (KR)

(72) Inventors: Sang-Kyu Kim, Goyang-si (KR); Jae-Kyeong Yoon, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 155 days.

(21) Appl. No.: 15/189,274

(22) Filed: Jun. 22, 2016

(65) Prior Publication Data

US 2016/0379555 A1 Dec. 29, 2016

(30) Foreign Application Priority Data

Jun. 29, 2015 (KR) ..... 10-2015-0092157

(51) Int. Cl.
*G09G 3/3291* (2016.01)

(52) U.S. Cl.
CPC ..... *G09G 3/3291* (2013.01); *G09G 2330/021* (2013.01); *G09G 2330/025* (2013.01); *G09G 2360/16* (2013.01)

(58) Field of Classification Search
CPC ..... G09G 3/3291; G09G 2330/025; G09G 2330/021
See application file for complete search history.

(56) References Cited

U.S. PATENT DOCUMENTS

2003/0210256 A1* 11/2003 Mori ..... G09G 3/3233 345/690
2007/0126757 A1* 6/2007 Itoh ..... G09G 3/3233 345/690
2008/0084510 A1* 4/2008 Toyooka ..... H04N 9/3155 348/779
2008/0225141 A1 9/2008 Ogawa
2009/0207193 A1* 8/2009 Isobe ..... G09G 3/3233 345/690
2009/0322796 A1* 12/2009 Yoshida ..... G09G 5/006 345/690
2010/0156955 A1 6/2010 Kimura
(Continued)

FOREIGN PATENT DOCUMENTS

CN 102479482 A 5/2012
CN 102810293 A 12/2012
(Continued)

*Primary Examiner* — Mihir K Rayan
(74) *Attorney, Agent, or Firm* — Dentons US LLP

(57) ABSTRACT

An organic light emitting diode display device including: a timing controller that receives an image signal and a plurality of timing signals from an external system and output an image data, a gate control signal and a data control signal; a peak luminance controlling unit that calculates a peak luminance according to an average picture level of the image data and calculates a modified peak luminance by modifying the peak luminance according to one or more of a color change and a scene change of the image data; a gate driver that generates a gate signal using the gate control signal; a data driver that generates a data signal using the modified peak luminance, the image data and the data control signal; and a display panel that displays an image using the gate signal and the data signal.

10 Claims, 4 Drawing Sheets

(56) References Cited

U.S. PATENT DOCUMENTS

| | | | | |
|---|---|---|---|---|
| 2010/0321581 | A1* | 12/2010 | Iwakura | G09G 3/288<br>348/687 |
| 2012/0306947 | A1* | 12/2012 | Kim | G09G 3/3233<br>345/694 |
| 2013/0063500 | A1* | 3/2013 | Oka | H04N 9/3155<br>345/690 |
| 2014/0146066 | A1* | 5/2014 | Kang | G09G 3/3225<br>345/545 |
| 2015/0062187 | A1* | 3/2015 | Park | G09G 3/3225<br>345/690 |

FOREIGN PATENT DOCUMENTS

| | | | | |
|---|---|---|---|---|
| CN | 104517568 | A | | 4/2015 |
| CN | 104700773 | A | | 6/2015 |
| KR | 20120125742 | | * | 5/2014 |

* cited by examiner

ORGANIC LIGHT EMITTING DIODE DISPLAY DEVICE INCLUDING PEAK LUMINANCE CONTROLLING UNIT AND METHOD OF DRIVING THE SAME

CROSS-REFERENCE TO RELATED APPLICATIONS

This application claims the benefit under 35 U.S.C. § 119(a) of Korean Patent Application No. 10-2015-0092157, filed on Jun. 29, 2015, in the Korean Intellectual Property Office, which is incorporated herein by reference in its entirety for all purposes as if fully set forth herein.

BACKGROUND

1. Technical Field

The present disclosure relates to an organic light emitting diode (OLED) display device, and more particularly, to an OLED display device including a peak luminance controller and a method of driving the same.

2. Discussion of the Related Art

Among various flat panel displays (FPDs), organic light emitting diode (OLED) display devices have superior properties such as high luminance and low driving voltage. An OLED display device uses an emissive electroluminescent layer to realize high contrast ratio and thin profile, and is excellent at displaying moving images due to its short response time of several micro seconds (μsec). Also, an OLED display device has a wide viewing angle and is stable even at a low temperature. Since an OLED display device is typically driven at a low voltage of about 5V to about 15V in direct current (DC), a fabrication and design of a driving circuit is relatively easy. Further, a fabrication process for an OLED display device including a deposition and an encapsulation is simple.

Since an OLED display device is a current driving type where a current is supplied to a light emitting diode to emit a light, which is different from a liquid crystal display (LCD) device, it becomes more beneficial to reduce driving current and power consumption.

A peak luminance control driving method has been suggested as one of methods for reducing the power consumption of an OLED display device and will be illustrated hereinafter with reference to drawings.

FIG. 1 is a view illustrating a peak luminance controlling unit of an OLED display device according to the related art, and FIG. 2 is a graph showing a peak luminance change with respect to an average picture level and a gamma curve of an OLED display device according to the related art.

In FIG. 1, a peak luminance controlling unit 10 of an OLED display device according to the related art includes an average picture level calculating unit 20 and a peak luminance calculating unit 30.

The average picture level calculating unit 20 receives an image data RGB and calculates an average picture level APL of the image data RGB of one frame.

The peak luminance calculating unit 30 receives the average picture level APL from the average picture level calculating unit 20 and calculates a peak luminance PL using the average picture level APL for application to the image data RGB of one frame. The peak luminance calculating unit 30 may store an information on a correlation between the average peak level and the peak luminance PL.

In FIG. 2, the peak luminance calculating unit 30 calculates about 400 nit(=cd/m$^2$) as the peak luminance PL at a first point 'a' where the average picture level APL is about 25%, calculates about 100 nit as the peak luminance PL at a second point 'b' where the average picture level APL is about 100%, and calculates a value between about 100 nit to about 400 nit as the peak luminance PL at a third point 'c' where the average picture level APL is between about 25% to about 100%.

The first point 'a' corresponds to a minimum average picture level where a peak luminance control begins, and the second point 'b' corresponds to a maximum average picture level having a minimum peak luminance. The first and second points 'a' and 'b' may variously change as desired.

As a result, when the average picture level APL is about 25%, the OLED display device displays an image of the corresponding frame according to a first gamma curve GCa where a luminance of a maximum gray level Gmax is about 400 nit. In addition, the OLED display device displays an image of the corresponding frame according to a second gamma curve GCb where a luminance of a maximum gray level Gmax is about 100 nit when the average picture level APL is about 100%, and the OLED display device displays an image of the corresponding frame according to a third gamma curve GCc where a luminance of a maximum gray level Gmax is between about 100 nit to about 400 nit when the average picture level APL is between 25% to about 100%.

The peak luminance PL calculated by the peak luminance controlling unit 10 is equal to or smaller than the maximum value of about 400 nit, and an image is displayed by using the peak luminance PL as a luminance corresponding to the maximum gray level of the image data RGB of one frame. As a result, a dynamic image can be displayed by using a relatively high luminance when the average picture level APL is relatively low, and the power consumption can be reduced by using a relatively low luminance when the average picture level APL is relatively high.

However, in the peak luminance control driving method according to the related art, since the peak luminance PL is controlled by analyzing merely the average picture level APL of the luminance information of an image, a perception level of the user may not be reflected. The perception level of the user may depend on color difference information of an image as well as luminance information of the image. Since the perception level of the user may not be reflected when controlling the peak luminance PL, the power consumption may be unnecessarily increased.

SUMMARY

Embodiments of the present disclosure relate to an organic light emitting diode display device and a method of driving the same that substantially obviate one or more of the problems due to limitations and disadvantages of the related art.

One embodiment is an organic light emitting diode display device where a power consumption is reduced by controlling a peak luminance based on a luminance information and a color change of an image reflecting a perception level of a user, and a method of driving the organic light emitting diode display device.

One embodiment is an organic light emitting diode display device where a power consumption is further reduced by controlling a peak luminance based on a luminance information, a color change and a scene change of an image reflecting a perception level of a user, and a method of driving the organic light emitting diode display device.

Advantages and features of the disclosure will be set forth in part in the description, which follows and in part will become apparent to those having ordinary skill in the art upon examination of the following or may be learned from practice of the disclosure. Other advantages and features of the embodiments herein may be realized and attained by the structure particularly pointed out in the written description and claims hereof as well as the appended drawings.

To achieve other advantages and features in accordance with the purpose according to one aspect of the disclosure, one embodiment is an organic light emitting diode display device including: a timing controller that receives an image signal and a plurality of timing signals from an external system and outputs an image data, a gate control signal and a data control signal; a peak luminance controlling unit that calculates a peak luminance according to an average picture level of the image data and calculates a modified peak luminance by modifying the peak luminance according to one or more of a color change and a scene change of the image data; a gate driver that generates a gate signal using the gate control signal; a data driver that generates a data signal using the modified peak luminance, the image data and the data control signal; and a display panel that displays an image using the gate signal and the data signal.

In another aspect, one embodiment is a method of driving an organic light emitting diode display device including: generating an image data, a gate control signal and a data control signal using an image signal and a plurality of timing signals; calculating a peak luminance according to an average picture level of the image data and calculating a modified peak luminance by modifying the peak luminance according to one or more of a color change and a scene change of the image data; generating a gate signal using the gate control signal; generating a data signal using the modified peak luminance, the image data and the data control signal; and displaying an image using the gate signal and the data signal.

It is to be understood that both the foregoing general description and the following detailed description are explanatory, and are intended to provide further explanation of the embodiments as claimed.

BRIEF DESCRIPTION OF THE DRAWINGS

The accompanying drawings, which are included to provide a further understanding of the disclosure, are incorporated in and constitute a part of this specification, illustrate implementations of the disclosure and together with the description serve to explain the principles of embodiments of the disclosure. In the drawings.

DETAILED DESCRIPTION OF THE ILLUSTRATED EMBODIMENTS

Figure 1:
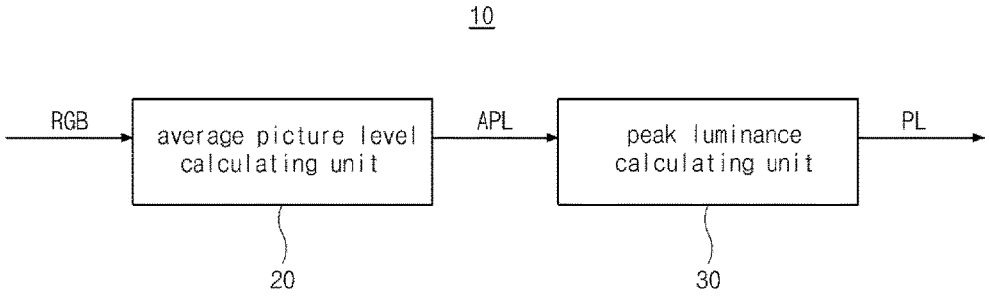
FIG. 1 Related Art
FIG. 1 is a view illustrating a peak luminance controlling unit of an organic light emitting diode display device according to the related art.
Figure 2:
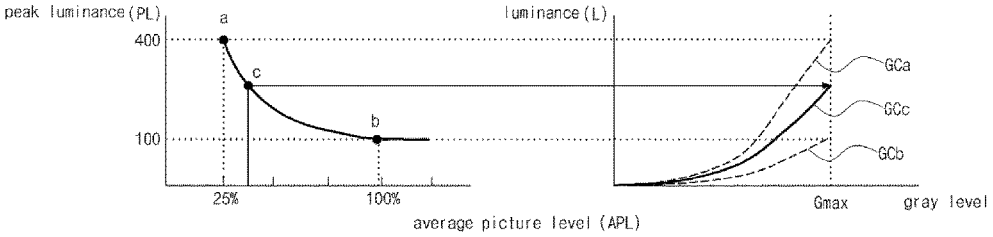
FIG. 2 Related Art
FIG. 2 is a graph showing a peak luminance change with respect to an average picture level and a gamma curve of an organic light emitting diode display device according to the related art.

Reference will now be made in detail to embodiments of the present disclosure, examples of which are illustrated in the accompanying drawings. In the following description, when a detailed description of well-known functions or configurations related to this document is determined to unnecessarily cloud a gist of an embodiment of the disclosure, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a certain order. Like reference numerals designate like elements throughout. Names of the respective elements used in the following explanations are selected only for convenience of writing the specification and may be thus different from those used in actual products.

Figure 3:
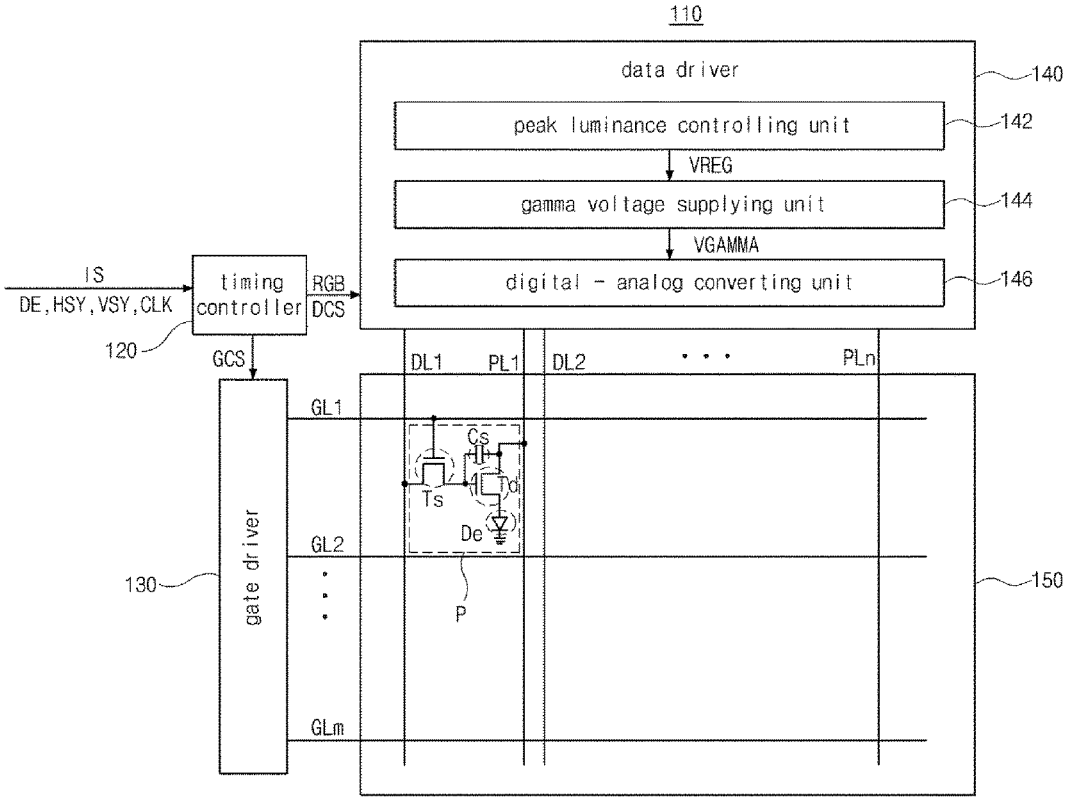
FIG. 3 is a view illustrating an organic light emitting diode display device according to the first embodiment of the present disclosure.

FIG. 3 is a view illustrating an organic light emitting diode (OLED) display device according to the first embodiment of the present disclosure.

In FIG. 3, an OLED display device 110 according to the first embodiment of the present disclosure includes a timing controller 120, a gate driver 130, a data driver 140 and an OLED panel 150.

The timing controller 120 receives an image signal IS and a plurality of timing signals such as a data enable signal DE, a horizontal synchronization signal HSY, a vertical synchronization signal VSY and a clock CLK from an external system such as a graphic card or a television system and outputs an image data RGB, a gate control signal GCS and a data control signal DCS.

The gate driver 130 generates a gate signal using the gate control signal GCS and outputs the gate signal to the OLED panel 150. The data driver 140 generates a data signal using the image data RGB and the data control signal DCS and outputs the data signal to the OLED panel 150.

The OLED panel 150 displays an image using the gate signal and the data signal. The OLED panel 150 includes first to mth gate lines GL1 to GLm, first to nth data lines DL1 to DLn and first to nth power lines PL1 to PLn crossing each other to define a plurality of pixel regions P, and a switching transistor Ts, a driving transistor Td, a storage capacitor Cs and a light emitting diode (LED) De in each pixel region P. For example, the first to nth data lines DL1 to DLn may be connected to the pixel regions P displaying red, green and blue colors sequentially and repeatedly.

The switching transistor Ts functions as a switching element which supplies the data signal of the first to nth data lines DL1 to DLn to the driving transistor Td according to the gate signal of the first to mth gate lines GL1 to GLm, and the driving transistor Td functions as a driving element which supplies a source voltage of the first to nth power lines PL1 to PLn to the LED De according to the data signal applied to a gate electrode through the switching transistor Ts. As a result, an amount of current corresponding to the data signal is supplied to the LED De to display various gray levels.

The data driver 140 calculates a peak luminance PL of a maximum gray level of an image data RGB of one frame according to an average picture level APL of the image data RGB of one frame, calculates a modified peak luminance MPL by modifying the peak luminance PL according to a color change of the image data RGB of one frame, and generates the data signal using the modified peak luminance MPL.

When a color change of the image data RGB is equal to or greater than a reference value, the data driver 140 may calculate the modified peak luminance MPL by decreasing the peak luminance PL obtained according to the average picture level APL. When the color change of the image data RGB is smaller than the reference value, the data driver 140 may calculate the modified peak luminance MPL based on the peak luminance PL obtained according to the average picture level APL.

The data driver 140 includes a peak luminance controlling unit 142 which calculates the modified peak luminance MPL and generates a gamma source voltage VREG using the modified peak luminance MPL, a gamma voltage supplying unit 144 which generates a plurality of gamma voltages VGAMMA using the gamma source voltage VREG and a digital-analog converting unit 146 which converts the image data RGB of digital type to the data signal of analog type using the plurality of gamma voltages VGAMMA and outputs the data signal of analog type.

The gamma voltage supplying unit 144 may include a plurality of resistor strings, and the gamma source voltage VREG and a ground voltage may be connected to both ends of at least one of the plurality of resistor strings. The plurality of gamma voltages VGAMMA may be outputted from nodes between resistors and may be proportional to the gamma source voltage VREG.

Specifically, the peak luminance controlling unit 142 may generate the gamma source voltage VREG by calculating the peak luminance PL and calculating the modified peak luminance MPL according to a color change of the image data RGB of one frame. The peak luminance controlling unit 142 will now be described in detail.

Figure 4:
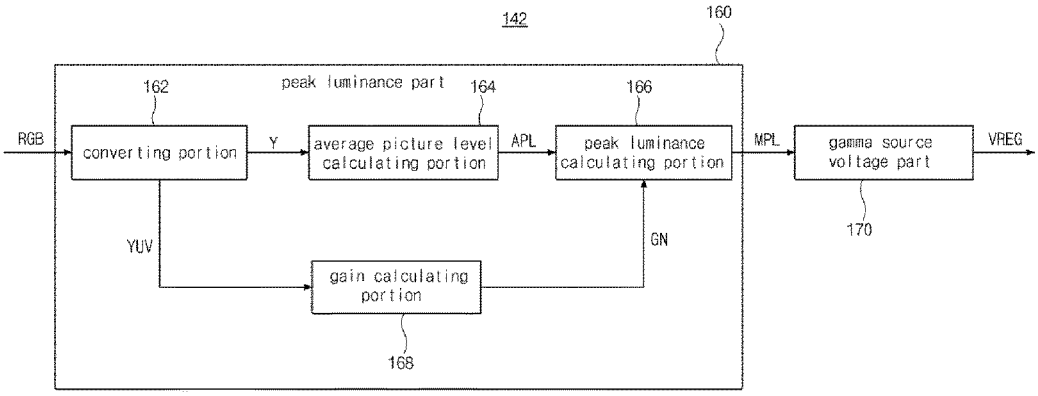
FIG. 4 is a view illustrating a peak luminance controlling unit of an organic light emitting diode display device according to the first embodiment of the present disclosure.

FIG. 4 is a view illustrating a peak luminance controlling unit of an OLED display device according to the first embodiment of the present disclosure.

In FIG. 4, a peak luminance controlling unit 142 of an OLED display device 110 (of FIG. 3) according to the first embodiment of the present disclosure includes a peak luminance part 160 which calculates a peak luminance PL and a modified peak luminance MPL using an image data RGB and a gamma source voltage part 170 which generates a gamma source voltage VREG.

The peak luminance part 160 includes a converting portion 162, an average picture level calculating portion 164, a peak luminance calculating portion 166 and a gain calculating portion 168.

The converting portion 162 receives the image data RGB from a timing controller (of FIG. 3) and converts the image data RGB of red, green and blue color components R, G and B into a converted image data YUV of a luminance component Y, a blue color difference component U and a red color difference component V. The converting portion 162 extracts the luminance component Y of each pixel region P from the converted image data YUV and outputs the luminance component Y of each pixel region P to the average picture level calculating portion 164. In addition, the converting portion 162 extracts the luminance component Y, the blue color difference component U and the red color difference component V from the converted image data YUV and outputs the luminance component Y, the blue color difference component U and the red color difference component V to the gain calculating portion 168.

The luminance component Y, the blue color difference component U and the red color difference component V of the converted image data YUV may be obtained from the red, green and blue color components R, G and B of the image data RGB according to the following equations.

$$Y=+0.299R+0.587G+0.114B$$

$$U=-0.168736R-0.331264G+0.5B$$

$$V=+0.5R-0.418688G-0.081312B$$

The average picture level calculating portion 164 calculates an average picture level APL by averaging the luminance components Y of the plurality of pixel regions receiving from the converting portion 164 and outputs the average picture level APL.

The average picture level APL may be obtained from the luminance components Y of the plurality of pixel regions according to the following equation.

$$APL=AVG(Y1, \ldots, Yn)=(Y1+Y2+\ldots+Yn)/n \text{ (}n\text{ is a number of the plurality of pixel regions)}$$

The peak luminance calculating portion 166 calculates a peak luminance PL of a maximum gray level of the image data RGB of one frame according to the average picture level APL received from the average picture level calculating portion 164.

Figure 6:
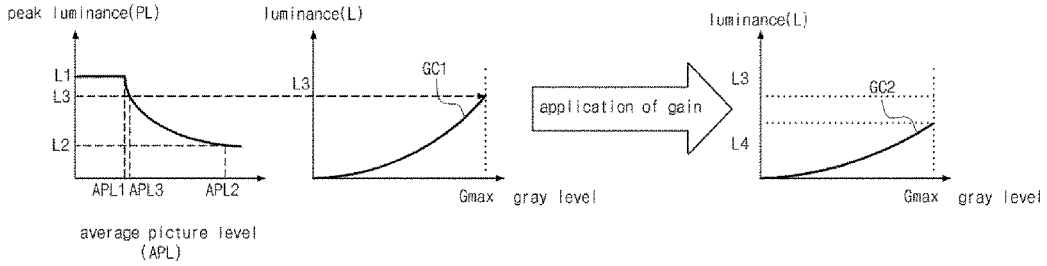
FIG. 6 is a graph showing a driving result of an organic light emitting diode display device according to the first embodiment of the present disclosure.

For example, the peak luminance calculating portion 166 may calculate a first luminance L1 (of FIG. 6) as the peak luminance of a maximum gray level Gmax (of FIG. 6) of the image data RGB for an image smaller than a first average picture level APL1 (of FIG. 6) and may calculate a second luminance L2 (of FIG. 6) as the peak luminance of the maximum gray level Gmax of the image data RGB for an image of a second average picture level APL2 (of FIG. 6). In addition, the peak luminance calculating portion 166 may calculate a third luminance L3 (of FIG. 6) between the first and second luminances L1 and L2 as the peak luminance of the maximum gray level Gmax of the image data RGB for an image of a third average picture level APL3 (of FIG. 6).

The third luminance L3 may be a value which decreases between the first and second luminances L1 and L2 as the average picture level APL increases.

In addition, the peak luminance calculating portion 166 calculates the modified peak luminance MPL by applying a gain GN to the peak luminance PL and outputs the modified peak luminance MPL.

The gain calculating portion 168 receives the luminance component Y, the blue color difference component U and the red color difference component V of each pixel region P from the converting portion 162, and calculates an average luminance component avgY, an average blue color difference component avgU and an average red color difference component avgV by averaging the luminance component Y, the blue color difference component U and the red color difference component V, respectively, for the plurality of pixel regions P.

In addition, after the gain calculating portion 168 calculates a variance of the average luminance component avgY, a variance of the average blue color difference component avgU and a variance of the average red color difference component avgV for sequential two frames, the gain calculating portion 168 compares the variance of the average luminance component avgY with a predetermined reference luminance variance.

When the variance of the average luminance component avgY is smaller than the reference luminance variance, the gain calculating portion 168 compares the variance of the average blue color difference component avgU with a predetermined reference blue color difference variance and compares the variance of the average red color difference component avgV with a predetermined reference red color difference variance.

When the variance of the average blue color difference component avgU is equal to or greater than the reference blue color difference variance or when the variance of the average red color difference component avgV is equal to or greater than the reference red color difference variance, the gain calculating portion 168 calculates the gain GN for decreasing the peak luminance PL in accordance with the variance of the average blue color difference component avgU or the variance of the average red color difference component avgV, and outputs the gain GN to the peak luminance calculating portion 166.

The converting portion 162 or the gain calculating portion 168 may include a storing portion for storing the image data RGB of two frames or the converted image data YUV of two frames. The gain GN may be a value smaller than 1 which decreases as the variance of the average blue color difference component avgU or the variance of the average red color difference component avgV increases.

The gamma source voltage part 170 receives the modified peak luminance MPL from the peak luminance calculating portion 166 and generates the gamma source voltage VREG using the modified peak luminance MPL.

Although the peak luminance controlling unit 142 is disposed in the data driver 140 in the first embodiment, the peak luminance controlling unit may be disposed in the timing controller in another embodiment.

A method of driving the OLED display device 110 will now be described in detail.

Figure 5:
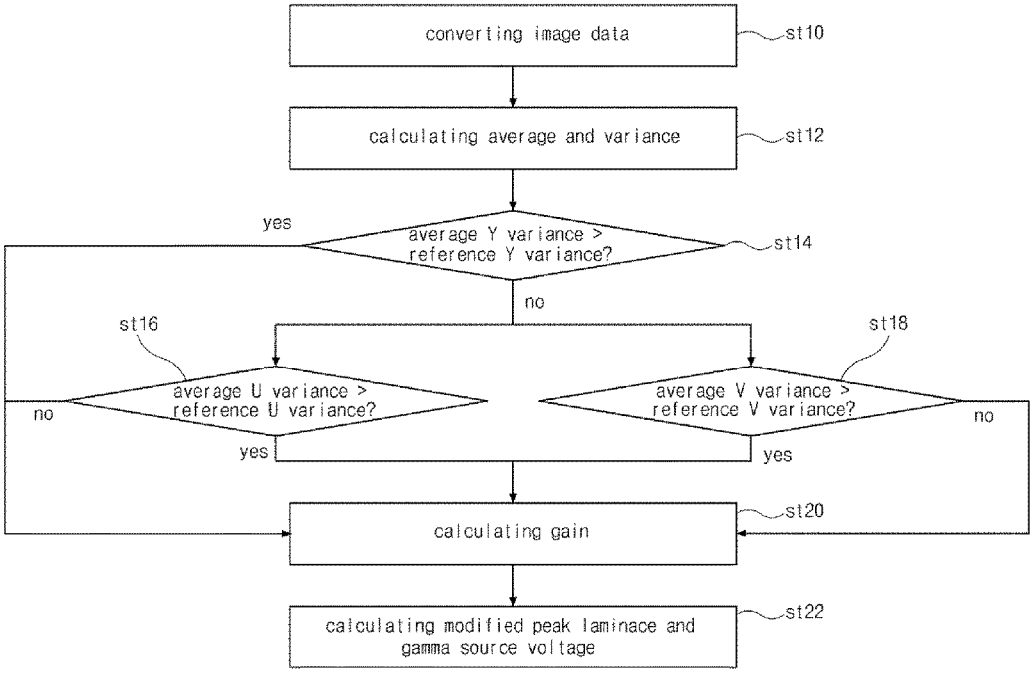
FIG. 5 is a flow chart illustrating a method of driving an organic light emitting diode display device according to the first embodiment of the present disclosure.

FIG. 5 is a flow chart illustrating a method of driving an OLED display device according to the first embodiment of the present disclosure, and FIG. 6 is a graph showing a driving result of an OLED display device according to the first embodiment of the present disclosure.

In FIG. 5, the converting portion 162 (of FIG. 4) of the peak luminance part 160 (of FIG. 4) of the OLED display device 110 (of FIG. 3) converts the image data RGB (of FIG. 4) of the red, green and blue color components R, G and B into the converted image data YUV (of FIG. 4) of the luminance component Y, the blue color difference component U and the red color difference component V (st10).

In addition, the average picture level calculating portion 164 (of FIG. 4) of the peak luminance part 160 calculates the average picture level APL (of FIG. 4) by averaging the luminance components Y of the plurality of pixel regions, and the peak luminance calculating portion 166 (of FIG. 4) of the peak luminance part 160 calculates the peak luminance PL (of FIG. 4) of a maximum gray level of the image data RGB of one frame according to the average picture level APL.

Next, the gain calculating portion 168 (of FIG. 4) of the peak luminance part 160 calculates the average luminance component avgY (of FIG. 4), the average blue color difference component avgU (of FIG. 4) and the average red color difference component avgV (of FIG. 4) for the plurality of pixel regions P from the converted image data YUV, and calculates the variance of the average luminance component avgY, the variance of the average blue color difference component avgU and the variance of the average red color difference component avgV for sequential two frames (st12).

For example, when the converted image data YUV of an (n−1)th frame has an (n−1)th average luminance component avgY(n−1), an (n−1)th average blue color difference component avgU(n−1) and an (n−1)th average red color difference component avgV(n−1), and the converted image data YUV of an (n)th frame has an (n)th average luminance component avgY(n), an (n)th average blue color difference component avgU(n) and an (n)th average red color difference component avgV(n), the gain calculating portion 168 may calculate the variance of the average luminance component (|avgY(n)−avgY(n−1)|) from an absolute value of a difference between the (n−1)th average luminance component avgY(n−1) and the (n)th average luminance component avgY(n). In addition, the gain calculating portion 168 may calculate the variance of the average blue color difference component (|avgU(n)−avgU(n−1)|) from an absolute value of a difference between the (n−1)th average blue color difference component avgU(n−1) and the (n)th average blue color difference component avgU(n) and may calculate the variance of the average red color difference component (|avgV(n)−avgV(n−1)|) from an absolute value of a difference between the (n−1)th average red color difference component avgV(n−1) and the (n)th average red color difference component avgV(n).

Next, the gain calculating portion 168 compares the variance of the average luminance component avgY with the reference luminance variance (st14).

Next, when the variance of the average luminance component avgY is equal to or greater than the reference luminance variance, the gain calculating portion 168 determines that the image of the corresponding frame has a relatively great luminance change and calculates the gain GN of 1 so that the general peak luminance control driving method can be applied (st20).

When the variance of the average luminance component avgY is smaller than the reference luminance variance, the gain calculating portion 168 determines that the image of the corresponding frame has a relatively small luminance change, compares the variance of the average blue color difference component avgU with the reference blue color difference variance (st16), and compares the variance of the red color difference component avgV with the reference red color difference variance (st18).

When the variance of the average blue color difference component avgU is smaller than the reference blue color difference variance and the variance of the red color difference component avgV is smaller than the reference red color difference variance, the gain calculating portion 168 determines that the image of the corresponding frame has a relatively small color change and calculates the gain GN of 1 so that the general peak luminance control driving method can be applied (st20).

When the variance of the average blue color difference component avgU is equal to or greater than the reference blue color difference variance or the variance of the red color difference component avgV is equal to or greater than the reference red color difference variance, the gain calculating portion 168 determines that the image of the corresponding frame has a relatively great color change and calculates the gain GN as a value smaller than 1 so that the peak luminance PL can decrease to be smaller than the peak luminance of the general peak luminance control driving method (st20).

Next, the peak luminance calculating portion 166 calculates the modified peak luminance MPL by applying the gain GN to the peak luminance PL (st22).

When the variance of the average luminance component avgY is smaller than the reference luminance variance, and the variance of the average blue color difference component avgU is equal to or greater than the reference blue color difference variance or the variance of the average red color difference component avgV is equal to or greater than the reference red color difference variance, e.g., when the image of the corresponding frame has a relatively small luminance change and a relatively great color change, the modified peak luminance MPL is calculated by multiplying the gain GN smaller than 1 and the peak luminance PL, and the image is displayed according to the gamma curve corresponding to the modified peak luminance MPL. As a result, the power consumption can further be reduced.

For a moving image where its luminance change is relatively small and color change is relatively great, reduction in display quality according to reduction in luminance is relatively low. When a user watches an image having a relatively small luminance change and a relatively great color change, the user seldom perceives reduction in luminance because the optic nerve and the brain of the user focus on an analysis of color change. Accordingly, the power consumption can be reduced in a state that the user does not perceive reduction in display quality.

In FIG. 6, the peak luminance calculating portion 166 (of FIG. 4) of the peak luminance part 160 (of FIG. 4) calculates a first luminance L1 as the peak luminance PL for an image smaller than a first average picture level APL1 and calculates a second luminance L2 as the peak luminance PL for an image of a second average picture level APL2. In addition, the peak luminance calculating portion 166 calculates a third luminance L3 between the first and second luminances L1 and L2 as the peak luminance PL for an image of a third average picture level APL3 between the first and second average picture levels APL1 and APL2.

When the variance of the average luminance component avgY of the corresponding image is smaller than the reference luminance variance, and when the variance of the average blue color difference component avgU is equal to or greater than the reference blue color difference variance or when the variance of the average red color difference component avgV is equal to or greater than the reference red color difference variance, the gain calculating portion 168 calculates the gain GN as a value smaller than 1 and the peak luminance calculating portion 166 calculates the modified peak luminance MPL by multiplying the gain GN smaller than 1 and the peak luminance PL.

For example, the peak luminance calculating portion 166 may calculate a fourth luminance L4 smaller than the third luminance L3 as the modified peak luminance MPL by multiplying the gain GN smaller than 1 and the peak luminance PL of the third luminance L3.

When the variance of the average luminance component avgY of the corresponding image is smaller than the reference luminance variance, and when the variance of the average blue color difference component avgU is equal to or greater than the reference blue color difference variance or when the variance of the average red color difference component avgV is equal to or greater than the reference red color difference variance, the OLED display device 110 (of FIG. 3) displays an image according to a second gamma curve where the maximum gray level Gmax corresponds to the fourth luminance L4 instead of a first gamma curve where the maximum gray level Gmax corresponds to the third luminance L3. As a result, the power consumption can further be reduced.

For example, when a standard moving image is driven by the general peak luminance control driving method using the peak luminance PL, an amount of power consumption was about 16.2 Wh. When the same standard moving image is driven by a driving method according to the first embodiment using the modified peak luminance MPL, an amount of power consumption was about 12.8 Wh, which indicates that the driving method according to the first embodiment using the modified peak luminance MPL has the power consumption reduced by about 20.5% as compared with the general peak luminance control driving method using the peak luminance PL.

Another embodiment where peak luminance is controlled based on a scene change as well as a color change will now be described in detail.

Figure 7:
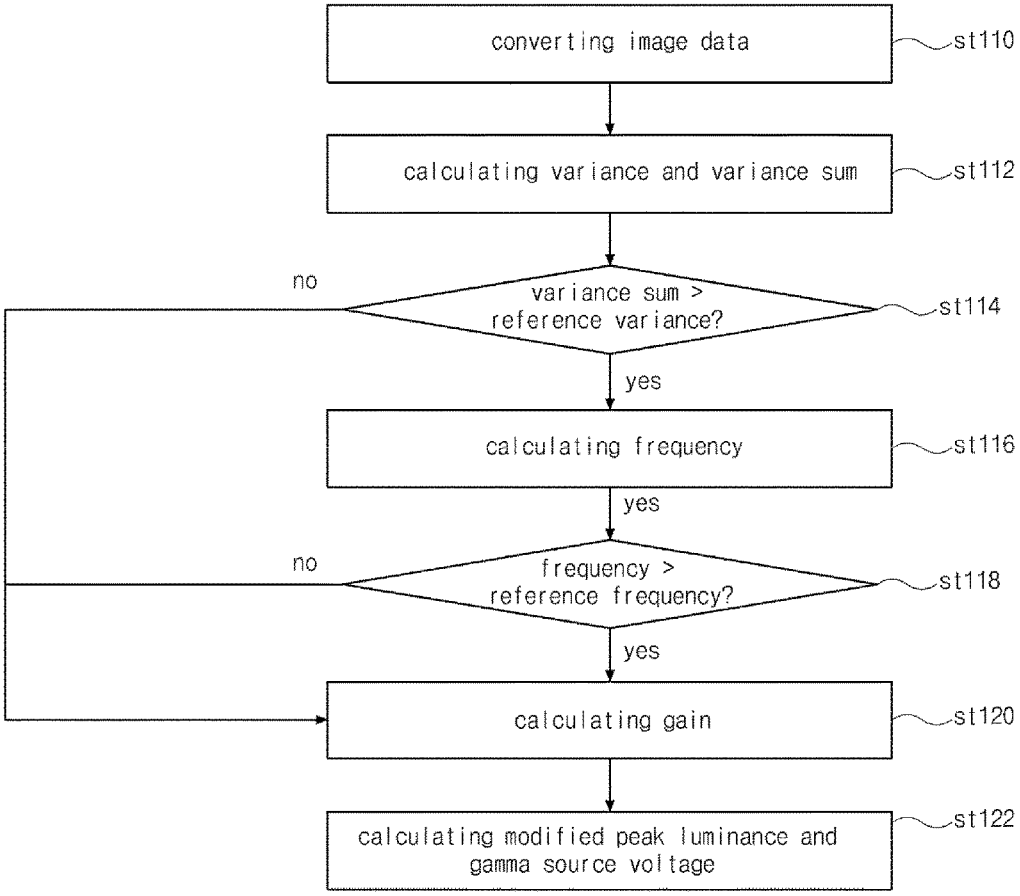
FIG. 7 is a flow chart illustrating a method of driving an organic light emitting diode display device according to the second embodiment of the present disclosure.

FIG. 7 is a flow chart illustrating a method of driving an OLED display device according to the second embodiment of the present disclosure. Since a structure of an OLED display device according to the second embodiment is substantially the same as a structure of an OLED display device according to the first embodiment, the second embodiment will be described with reference to FIGS. 3 and 4 for brevity.

In FIG. 7, the converting portion 162 (of FIG. 4) of the peak luminance part 160 (of FIG. 4) of the OLED display device 110 (of FIG. 3) according to the second embodiment converts the image data RGB (of FIG. 4) of the red, green and blue color components R, G and B into the converted image data YUV (of FIG. 4) of the luminance component Y, the blue color difference component U and the red color difference component V (st110).

In addition, the average picture level calculating portion 164 (of FIG. 4) of the peak luminance part 160 calculates the average picture level APL (of FIG. 4) by averaging the luminance components Y of the plurality of pixel regions, and the peak luminance calculating portion 166 (of FIG. 4) of the peak luminance part 160 calculates the peak luminance PL (of FIG. 4) of a maximum gray level of the image data RGB of one frame according to the average picture level APL.

Next, the gain calculating portion 168 (of FIG. 4) of the peak luminance part 160 calculates a variance of the luminance component Y, a variance of the blue color difference component U and a variance of the red color difference component V for the plurality of pixel regions P from the converted image data YUV of the sequential two frames and adds the variances of the luminance component Y, the blue color difference component U and the red color difference component V (st112).

For example, when the converted image data YUV of an (n−1)th frame has an (n−1)th luminance component Y(n−1), an (n−1)th blue color difference component U(n−1) and an (n−1)th red color difference component V(n−1), and the converted image data YUV of an (n)th frame has an (n)th luminance component Y(n), an (n)th blue color difference component U(n) and an (n)th red color difference component V(n), the gain calculating portion 168 may calculate a variance sum of the luminance component, the blue color difference component and the red color difference component $(\Sigma|Y(n)-Y(n-1)|+\Sigma|U(n)-U(n-1)|-\Sigma|V(n)-V(n-1)|)$ from a sum of an absolute value of a difference between the (n−1)th luminance component Y(n−1) and the (n)th luminance component Y(n), an absolute value of a difference between the (n−1)th blue color difference component U(n−1) and the (n)th blue color difference component U(n) and an absolute value of a difference between the (n−1)th red color difference component V(n−1) and the (n)th red color difference component V(n).

Next, the gain calculating portion 168 compares the variance sum of the luminance component Y, the blue color difference component U and the red color difference component V with the reference variance (st114).

Next, when the variance sum of the luminance component Y, the blue color difference component U and the red color difference component V is smaller than the reference variance, the gain calculating portion 168 determines that the image of the corresponding frame has a relatively small scene change (shot change) and calculates the gain GN of 1 so that the general peak luminance control driving method can be applied (st120).

When the variance sum of the luminance component Y, the blue color difference component U and the red color difference component V is equal to or greater than the reference variance, the gain calculating portion 168 determines that the image of the corresponding frame has a relatively great scene change and calculates a frequency of the scene change for a predetermined time period (e.g., 1 frame to 99 frames) (st116).

Here, a scene (a shot) means an image information in several frames (e.g., 1 frame to 9 frames), and a scene change or a scene switch means a change from one scene to another scene.

Although a scene change is detected by using the variance sum of the luminance component, the blue color difference component and the red color difference component in the first embodiment, the scene change may be detected by using a histogram in another embodiment.

Next, the gain calculating 168 compares the frequency of the scene change with a reference frequency (st118).

When the frequency of the scene change is smaller than the reference frequency, the gain calculating portion 168 determines that the image of the corresponding frame has a relatively small scene change and calculates the gain GN of 1 so that the general peak luminance control driving method can be applied (st120).

When the frequency of the scene change is equal to or greater than the reference frequency, the gain calculating portion 168 determines that the image of the corresponding frame has a relatively great scene change and calculates the gain GN as a value smaller than 1 so that the peak luminance PL can decrease to be smaller than the peak luminance of the general peak luminance control driving method (st120).

Next, the peak luminance calculating portion 166 calculates the modified peak luminance MPL by applying the gain GN to the peak luminance PL (st122).

When the variance sum of the luminance component Y, the blue color difference component U and the red color difference component V is equal to or greater than the reference frequency for the predetermined time period, e.g., when the image of the corresponding frame has a relatively great scene change, the modified peak luminance MPL is calculated by multiplying the gain GN smaller than 1 and the peak luminance PL and the image is displayed according to the gamma curve corresponding to the modified peak luminance MPL. As a result, the power consumption can be further reduced.

When a user watches an image such as a stage performance image where its scene change is relatively great, the user seldom perceives reduction in luminance because the optic nerve and the brain of the user focus on an analysis of the content and the change of the scene. Accordingly, the power consumption can be reduced in a state that the user does not perceive reduction in display quality.

In an OLED display device according to an embodiment of the present disclosure, since a peak luminance is controlled based on luminance information and color change of an image reflecting a perception level of a user, power consumption can be reduced. In addition, since a peak luminance is controlled based on luminance information, a color change and a scene change of an image reflecting a perception level of a user, power consumption can be further reduced.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting diode display device comprising:

a timing controller that receives an image signal and a plurality of timing signals from an external system and outputs an image data, a gate control signal and a data control signal;

a peak luminance controlling unit configured to calculate a peak luminance according to an average picture level of the image data and calculates a modified peak luminance by modifying the peak luminance according to one or more of a color change and a scene change of the image data;

a gate driver that generates a gate signal using the gate control signal;

a data driver that generates a data signal using the modified peak luminance, the image data and the data control signal; and a display panel that displays an image using the gate signal and the data signal, wherein the peak luminance controlling unit comprises:

a peak luminance part configured to calculate the peak luminance and the modified peak luminance using the image data; and a gamma source voltage part configured to generate a gamma source voltage using the modified peak luminance, wherein the peak luminance part comprises:

a converting portion configured to convert the image data of red, green and blue color components into a converted image data of a luminance component, a blue color difference component and a red color difference component;

an average picture level calculating portion configured to calculate the average picture level from an average of the luminance component;

a gain calculating portion configured to calculate a gain from the luminance component, the blue color difference component and the red color difference component of sequential two frames; and a peak luminance calculating portion configured to calculate the peak luminance according to the average picture level and to calculate the modified peak luminance for a maximum gray level of the image data by modifying the peak luminance according to the gain.

2. The display device of claim 1, wherein the gain calculating portion calculates:

the gain as 1 when a variance of an average of the luminance component of the sequential two frames is equal to or greater than a reference luminance variance;

the gain as 1 when the variance of the average of the luminance component of the sequential two frames is smaller than the reference luminance variance, when a variance of an average of the blue color difference component of the sequential two frames is smaller than a reference blue color difference variance, and when an average of the red color difference component of the sequential two frames is smaller than a reference red color difference variance; and the gain as a value smaller than 1 when the variance of the average of the luminance component of the sequential two frames is smaller than the reference luminance variance, and when the variance of an average of the blue color difference component of the sequential two frames is equal to or greater than the reference blue color difference variance or when the average of the red color difference component of the sequential two frames is equal to or greater than the reference red color difference variance.

3. The display device of claim 2, wherein gain calculating portion calculates:

the variance of the average of the luminance component from an absolute value of a difference between the average of the luminance component of an (n−1)th frame and the average of the luminance component of an (n)th frame;

the variance of the average of the blue color difference component from an absolute value of a difference between the average of the blue color difference component of the (n−1)th frame and the average of the blue color difference component of the (n)the frame; and the variance of the average of the red color difference component from an absolute value of a difference between the average of the red color difference component of the (n−1)th frame and the average of the red color difference component of the (n)the frame.

4. The display device of claim 1, wherein the gain calculating portion calculates:

the gain as 1 when a sum of a variance of the luminance component, a variance of the blue color difference component and a variance of the red color difference component of the sequential two frames is smaller than a reference variance or when a frequency of the scene change is smaller than a reference frequency; and the gain as a value smaller than 1 when the sum of the variance of the luminance component, the variance of the blue color difference component and the variance of the red color difference component of the sequential two frames is equal to or greater than the reference variance, and when the frequency of the scene change is equal to or greater than the reference frequency.

5. The display device of claim 4, wherein the gain calculating portion calculates the sum of the variance of the luminance component, the variance of the blue color difference component and the variance of the red color difference from a sum of an absolute value of a difference between the luminance component of an (n−1)th frame and the luminance component of an (n)th frame, an absolute value of a difference between the blue color difference component of the (n−1)th frame and the blue color difference component of the (n)th frame and an absolute value of a difference between the red color difference component of the (n−1)th frame and the red color difference component of the (n)th frame.

6. A method of driving an organic light emitting diode display device, comprising:

generating an image data, a gate control signal and a data control signal using an image signal and a plurality of timing signals;

calculating a peak luminance according to an average picture level of the image data and calculating a modified peak luminance by modifying the peak luminance according to one or more of a color change and a scene change of the image data;

generating a gate signal using the gate control signal;

generating a data signal using the modified peak luminance, the image data and the data control signal; and displaying an image using the gate signal and the data signal, wherein calculating the peak luminance comprises:

converting the image data of red, green and blue color components into a converted image data of a luminance component, a blue color difference component and a red color difference component;

calculating the average picture level from an average of the luminance component; and calculating the peak luminance corresponding to the average picture level, wherein calculating the modified peak luminance comprises:

calculating a gain from the luminance component, the blue color difference component and the red color difference component of sequential two frames; and calculating the modified peak luminance for a maximum gray level of the image data by modifying the peak luminance according to the gain.

7. The method of claim 6, wherein calculating the gain comprises:

comparing a variance of an average of the luminance component of the sequential two frames with a reference luminance variance;

calculating the gain as 1 when the variance of the average of the luminance component of the sequential two frames is equal to or greater than the reference luminance variance;

comparing a variance of an average of the blue color difference component of the sequential two frames with a reference blue color difference variance and comparing an average of the red color difference component of the sequential two frames with a reference red color difference variance when the variance of the average of the luminance component of the sequential two frames is smaller than the reference luminance variance;

calculating the gain as 1 when the variance of the average of the blue color difference component of the sequential two frames is smaller than the reference blue color difference variance, and when the average of the red color difference component of the sequential two frames is smaller than the reference red color difference variance; and calculating the gain as a value smaller than 1 when the variance of an average of the blue color difference component of the sequential two frames is equal to or greater than the reference blue color difference variance or when the average of the red color difference component of the sequential two frames is equal to or greater than the reference red color difference variance.

8. The method of claim 7, wherein calculating the gain further comprises:

calculating the variance of the average of the luminance component from an absolute value of a difference between the average of the luminance component of an (n−1)th frame and the average of the luminance component of an (n)th frame;

calculating the variance of the average of the blue color difference component from an absolute value of a difference between the average of the blue color difference component of the (n−1)th frame and the average of the blue color difference component of the (n)the frame; and calculating the variance of the average of the red color difference component from an absolute value of a difference between the average of the red color difference component of the (n−1)th frame and the average of the red color difference component of the (n)the frame.

9. The method of claim 6, wherein calculating the gain comprises:

comparing a sum of a variance of the luminance component, a variance of the blue color difference component and a variance of the red color difference component of the sequential two frames with a reference variance;

calculating the gain as 1 when the sum of the variance of the luminance component, the variance of the blue color difference component and the variance of the red color difference component of the sequential two frames is smaller than the reference variance;

comparing a frequency of the scene change with a reference frequency when the sum of the variance of the luminance component, the variance of the blue color difference component and the variance of the red color difference component of the sequential two frames is equal to or greater than the reference variance;

calculating the gain as 1 when the frequency of the scene change is smaller than the reference frequency; and calculating the gain as a value smaller than 1 when the frequency of the scene change is equal to or greater than the reference frequency.

10. The method of claim 9, wherein calculating the gain further comprises calculating the sum of the variance of the luminance component, the variance of the blue color difference component and the variance of the red color difference from a sum of an absolute value of a difference between the luminance component of an (n−1)th frame and the luminance component of an (n)th frame, an absolute value of a difference between the blue color difference component of the (n−1)th frame and the blue color difference component of the (n)th frame and an absolute value of a difference between the red color difference component of the (n−1)th frame and the red color difference component of the (n)th frame.

* * * * *